United States Patent [19]

Spars et al.

[11] Patent Number: 4,521,292

[45] Date of Patent: Jun. 4, 1985

[54] PROCESS FOR IMPROVING QUALITY OF PYROLYSIS OIL FROM OIL SHALES AND TAR SANDS

[75] Inventors: Byron G. Spars, Mill Valley; Robert J. Klett, San Francisco; P. Henrik Wallman, Berkeley, all of Calif.

[73] Assignee: Chevron Research Company, San Francisco, Calif.

[21] Appl. No.: 453,263

[22] Filed: Dec. 27, 1982

[51] Int. Cl.[3] ..... C10G 1/00

[52] U.S. Cl. ..... 208/11 R

[58] Field of Search ..... 208/11 R

[56] References Cited

U.S. PATENT DOCUMENTS

| | | | |
|---|---|---|---|
| 3,018,243 | 1/1962 | Nevens | 208/11 |
| 3,034,979 | 5/1962 | Nevens | 208/11 |
| 3,954,597 | 5/1976 | Morrell . | |
| 4,113,602 | 9/1978 | Gorbaty et al. | 208/8 |
| 4,157,245 | 6/1979 | Mitchell et al. . | |
| 4,199,432 | 4/1980 | Tamm et al. . | |
| 4,219,402 | 8/1980 | DeGeorge | 208/8 |
| 4,246,093 | 1/1981 | Wolcott | 208/8 |
| 4,289,603 | 9/1981 | DeGeorge | 208/8 |
| 4,320,795 | 3/1982 | Gwyn et al. . | |

OTHER PUBLICATIONS

Cameron Synthetic Fuel Report, Mar. 1981.

*Primary Examiner*—D. E. Gantz
*Assistant Examiner*—Lance Johnson
*Attorney, Agent, or Firm*—S. R. La Paglia; J. W. Ambrosius; Q. T. Dickinson

[57] ABSTRACT

A heavy oil fraction of pyrolysis oil vapors containing concentrated contaminants is coked on the hot mixture of pyrolyzed solids and heat transfer material in a retorting vessel provided with an inert stripping gas of a velocity sufficient to lower the dew point of the pyrolysis oil.

10 Claims, 5 Drawing Figures

PROCESS FOR IMPROVING QUALITY OF PYROLYSIS OIL FROM OIL SHALES AND TAR SANDS

BACKGROUND OF THE INVENTION

Oil shale is a naturally occurring material which contains a hydrocarbonaceous component referred to as kerogen. Upon heating, the kerogen decomposes to release a hydrocarbon vapor which may be used as a feedstock in petroleum processing. This synthetic crude oil called "shale oil" contains relatively high levels of iron, arsenic, and nitrogen as compared to conventional petroleum. In addition, due to the fissile nature of the raw oil shale and to the friability of the inorganic residue remaining after pyrolysis, the shale oil is also contaminated with a significant amount of fine solids which may constitute as much as 10% by weight of the pyrolysis oil. This contamination usually must be reduced prior to downstream processing to prevent poisoning of the various catalysts and clogging of the equipment.

Another naturally occurring raw material for production of pyrolysis oil is tar sand that occurs in a variety of forms including fine-grain diatomite. In analogy to the kerogen in oil shale, bitumen in tar sands may be pyrolyzed to yield a pyrolysis oil similar to shale oil. Particulate contamination in tar sands derived oil is similar to that in shale oil.

The present invention is directed to a process for recovering pyrolysis oil from oil shale or tar sand of significantly reduced contamination and having a lower average molecular weight than otherwise may be recovered by the pyrolysis of these raw materials.

BRIEF DESCRIPTION OF THE INVENTION

The present invention is directed to an improved process for retorting a hydrocarbonaceous solid selected from the group consisting of oil shale and tar sand to recover pyrolysis oil of a lower average molecular weight and containing less contamination which comprises:

(a) mixing particulate raw hydrocarbonaceous solid with particulate hot heat transfer material to raise the raw hydrocarbonaceous solid to a temperature sufficient to pyrolyze the hydrocarbonaceous fraction;

(b) pyrolyzing the hydrocarbonaceous fraction in a vertical retorting vessel by retaining the mixture of raw hydrocarbonaceous solid and hot particulate heat transfer material therein for a time sufficient to decompose a significant amount of the hydrocarbonaceous fraction to form hydrocarbon vapors;

(c) passing a stripping gas through the mixture of hydrocarbonaceous solids and heat transfer material at a velocity sufficient to significantly lower the dew point of the evolved hydrocarbon vapors;

(d) recovering as pyrolysis products frpom the raw hydrocarbonaceous solid contaminated hydrocarbon vapors and a mixture of hot pyrolyzed solids and heat transfer material;

(e) condensing from said hydrocarbon vapors a high-boiling fraction containing concentrated contaminants;

(f) contacting the contaminated high-boiling hydrocarbon fraction with the hot mixture of pyrolyzed solids and heat transfer material so as to thermally crack the high-boiling fraction and to deposit the contaminants along with coke on the mixture of particles; and (g) withdrawing a product oil vapor of a lower average molecular weight and having substantially reduced contamination.

The term "hydrocarbonaceous solids" refers to oil shale and tar sands. Likewise, the term "hydrocarbonaceous fraction" refers to kerogen in the case of oil shale and bitumen in case of tar sands.

As used herein, the word "contamination" or "contaminants" refers to fine solids, metals, and non-metals which must be removed prior to refining. Thus, the term includes fine particles of pyrolyzed or feed solids, heat transfer material, and coke as well as compounds containing iron, nitrogen, arsenic, magnesium, calcium, sodium, sulfur, etc.

The heat transfer material is preferably recycled pyrolyzed oil shale or tar sand which has been passed through a combustion zone to burn off any carbonaceous residue and to provide heat for pyrolyzing the raw material. Other suitable heat transfer materials include particulate solids such as sand, rock, alumina, steel, ceramic compositions, etc., as well as mixtures of these materials.

Various types of retorting vessels are suitable for use with the present invention. In one preferred embodiment the retorting vessel is designed to control the gross vertical backmixing of the solids. For example, a retorting vessel employing a moving packed bed or a staged turbulent bed (see U.S. Pat. No. 4,199,432) would be satisfactory for practicing the process. The presence of stripping gas in the pyrolysis oil vapor serves to lower the condensation temperature for a given heavy oil fraction. A lower temperature prevents premature coking of the heavy oil fraction in the heavy oil condenser. Preferably, the high-boiling fraction is recycled to the retort in a location below the principle zone of pyrolysis. The high-boiling recycle may be in a liquid or partially liquid-partially vapor state when entering the retort. Steam may be added to the high-boiling recycle for atomization prior to injection into the retort. The pyrolyzed solids and the heat transfer material provide a satisfactory medium for coking the contaminated hydrocarbon fraction on the particles and thus removing the fine particulates with the coke.

DETAILED DESCRIPTION OF THE INVENTION

Figure 1:
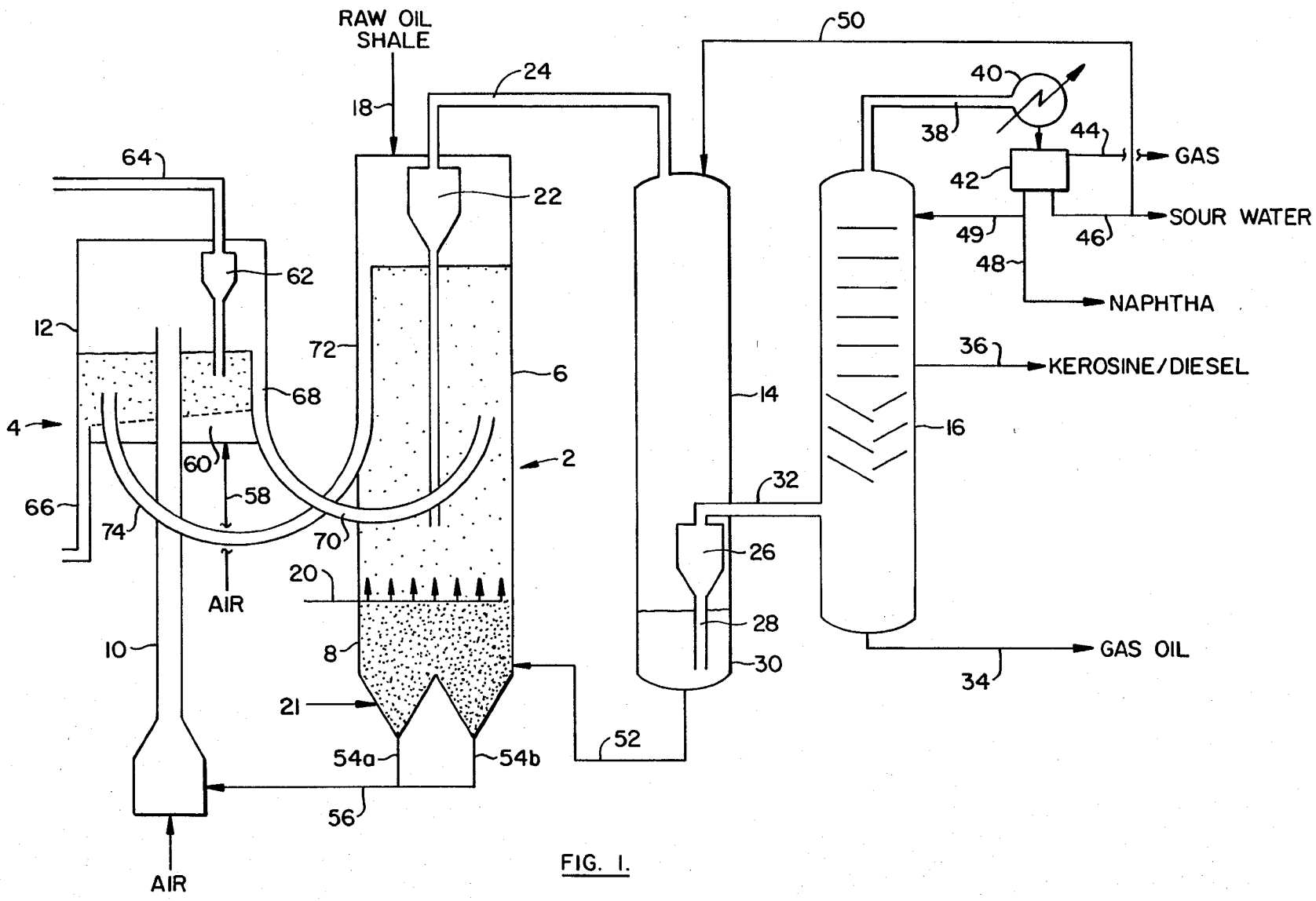
FIG. 1 shows a process for retorting oil shale wherein a heavy oil fraction of the product vapors containing contaminants is recycled to the retort to thermally crack the heavy oil to a lighter product and to remove the contaminants.
Figure 2:
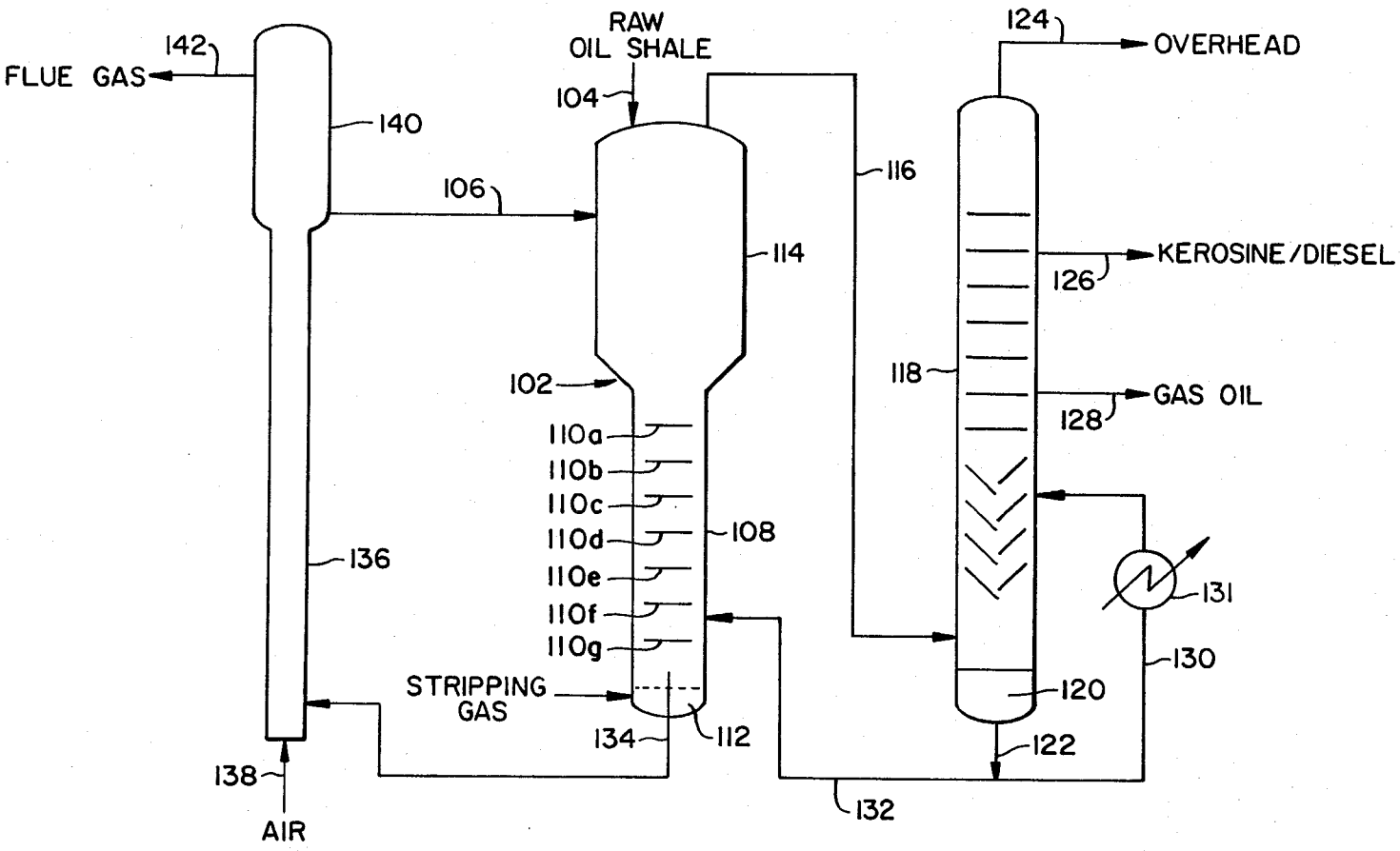
FIG. 2 illustrates an alternate embodiment of the invention using a staged turbulent bed to retort the raw oil shale. In this embodiment the contaminants are concentrated in the bottom fraction of the fractionator.

The present invention may be most easily understood by reference to the drawing. Shown in FIGS. 1 and 2 are schemes for recovering shale oil from oil shale. One skilled in the art will recognize that with appropriate modification the same basic processes may also be employed to recover product oil from tar sand. Shown in FIG. 1 is a retorting vessel 2 and a combustor 4. The retorting vessel 2 is divided into an upper zone 6 containing a fluidized bed of particles and a lower zone 8 containing a moving packed bed. The combustor 4 is divided into a liftpipe 10 and a secondary combustion and separation chamber 12. Also shown in the drawing is a heavy oil condenser 14 and a fractionator 16.

In operation, oil shale which has been crushed and ground to a maximum particle size of about one-half inch, is introduced by raw shale inlet 18 into the top of the fluidized bed contained in the upper zone 6 of the retorting vessel 2. The fluidized bed is composed of a mixture of hot heat transfer material from the combustor and oil shale particles of fluidizable size. In this embodiment the majority of the raw shale is composed of particles too large to be fluidized and will drop through the fluidized bed into the lower zone. Even so, the residence time of the non-fluidizable oil shale particles in the fluidized bed will be sufficient to raise the particles to a temperature sufficient to pyrolyze the kerogen, preferably about 900° F. The fluidization gas is composed of hydrocarbon vapors from the decomposition of the kerogen and supplemental stripping gas such as steam introduced into the bottom of the upper zone by gas inlet 20.

The non-fluidized particles along with some particles of fluidizable size drop out of the fluidized bed into the top of the moving packed bed contained in lower zone 8 of the retorting vessel 2. The heated raw oil shale particles are retained in the packed bed for a time sufficient to complete the pyrolysis of the kerogen in the oil shale, usually about 10 to 20 minutes depending upon the pyrolysis temperature. If desired, an additional stripping gas such as steam also may be injected through inlet port 21 into the bottom of the lower zone to aid in carrying away product vapors from that area.

The evolved hydrocarbon vapors pass upward, mix with the stripping gas entering at the bottom of the upper zone, and serve as fluidization gas for fluidizing the bed in the upper zone 6. The product vapors, stripping gas, and entrained fines enter cyclone 22 where the larger entrained particles are removed and returned to the fluidized bed. The gas and entrained fines exit the retort by means of gas outlet 24.

The product vapors pass via gas outlet 24 to heavy oil condenser 14 where the high-boiling fraction of the product vapors is condensed. In the embodiment shown in FIG. 1, the heavy oil condenser is an equilibrium spray tower cooled by injected sour water to between about 550°–700° F. The fine particles entrained in the gas stream entering the condenser act as condensation nuclei for the heavy oil. The oil-coated fines settle by gravity to the bottom of the tower or are collected by cyclone 26 which discharges the fines and heavy oil by dipleg 28 to the bottom reservoir 30. In addition to the fines collected in the heavy oil, it has been found other contaminants such as iron, arsenic, and nitrogen compounds are selectively enriched in the condensed heavy oil. The lighter uncondensed vapors leaving the heavy oil condenser via conduit 32 have a significantly lower amount of contamination compared to the product vapors leaving the retort.

An alternative to the spray tower shown in FIG. 1 is a tray tower with the equivalent of at least one equilibrium stage. Such a tower would be cooled by liquid reflux to the top tray, this reflux originating from the tower bottoms. Excess bottoms form the heavy oil recycle to the retort.

The relatively clean product vapors pass via conduit 32 to fractionator 16 where the raw shale oil is separated from non-condensible gas, lighter products and water. In the diagram gas oil is drawn off as a bottoms fraction from the tower via outlet 34. Kerosene/diesel fuel is recovered via outlet 36, and lighter overhead gases are recovered by overhead outlet 38. The overhead gases pass through cooler 40 where the condensible gases are cooled sufficiently to become liquid. In separator 42 non-condensible gases are recovered via outlet 44 separately from sour water and naphtha which are recovered via conduits 46 and 48, respectively. Naphtha is recycled to the top of the fractionator via recycle conduit 49. Sour water is recycled to the heavy oil condenser 14 by means of line 50 to cool fresh product vapors from the retort.

The condensed heavy oil laden with fine solids and other contaminants is carried from the bottom reservoir 30 of the heavy oil condenser by conduit 52 to the lower zone 8 of the retorting vessel 2.

It is preferable to minimize the residence time in reservoir 30 and conduit 52 where the heavy oil is in the liquid state to control premature coking and contact between shale fines and the liquid heavy oil. This contact has been found to result in undesirable dissolution of some metals such as calcium and magnesium from the shale fines. To avoid re-entrainment of the fine solids in the heavy oil, the slurry is fed into a low gas-velocity region of the moving packed bed. Preferably, this will be below the zone where the majority of the pyrolysis is occurring. Under these conditions, the heavy oil will be thermally cracked to produce a lower boiling product of reduced molecular weight. The coke deposited on the particles contained in the bed will also contain most of the particulate matter and most of the iron, nitrogen, arsenic, magnesium, calcium, and sodium contaminants. The cracking product vapor will be carried out of the retort with the primary product vapors via cyclone 22 and outlet 24. The resultant net oil product will have a higher API gravity, a lower pour point and reduced contamination.

The solids in the bottom of the moving packed bed consist of pyrolyzed oil shale containing a carbonaceous residue left upon decomposition of the kerogen, heat transfer material, coke containing the fines from the heavy oil and the other contaminants from the recycled heavy oil. These solids are withdrawn from the bottom of the lower zone 8 by drawpipes **54*a* and 54*b* and pass by L-valve 56 to the bottom of liftpipe 10 of the combustor 4. The particles are entrained in a stream of air and carried up the length of the liftpipe. During passage along the liftpipe the carbonaceous residue is ignited and partially burned. The partially burned particles exit the top of the liftpipe and enter the secondary combustion and separation chamber 12 of the combustor. Secondary air entering the bottom of chamber 12 via secondary air inlet 58 and plenum 60 serves as fluidization gas for the fluidized bed in the bottom of the chamber and as a source of oxygen for the combustion of any unburned carbon residue in the solids. Flue gases and entrained fines pass through rough cut cyclone 62 which recovers particles larger than a preselected size and returns them to the fluidized bed. The flue gas and fines leave the combustor by means of flue gas outlet 64. Non-fluidized particles settle to the bottom of the bed and are withdrawn by coarse solids drawpipe 66 for further processing and disposal. Thus, particles of entrainable size and non-fluidizable particles are removed from the secondary combustion and separation chamber 12**, while particles of fluidizable size are selectively retained for use as heat transfer solids.

The hot heat transfer solids, i.e. burned fluidizable shale particles, are withdrawn from the top of the fluidized bed in the secondary combustion and separation chamber by overflow well 68 and recycled to the fluidized bed in the upper zone 6 of the retorting vessel 2 by recycle conduit 70. Fluidized particles in the upper zone 6 of the retorting vessel are returned directly to the secondary combustion and separation zone via overflow well 72 and recycle conduit 74. Thus, the heat transfer material is continuously circulated between the upper zone 6 and the secondary combustion and separation zone 12.

FIG. 2 illustrates an alternate embodiment of the invention employing a staged turbulent bed to retort the raw oil shale. A full description of the staged turbulent bed and its operation is discussed in U.S. Pat. No. 4,199,432 the contents of which are herein incorporated by reference. In this embodiment particulate raw oil shale and hot heat transfer material enter the top of retort 102 via conduits 104 and 106, respectively. The lower section 108 of the retort contains internal baffles 110*a*, 110*b*, 110*c*, 110*d*, 110*e*, 110*f* and 110*g* which limit gross vertical backmixing of solids passing downward through the retort. An inert stripping gas is introduced into plenum chamber 112 and flows upward countercurrent to the solids cascading downward through the lower section of the retort. The velocity of the stripping gas is such that the solids are partially fluidized resulting in mixing of the raw oil shale and the heat transfer material. The pyrolyzed product vapors and entrained solids leave the top of the bed and pass through the upper expanded section 114 of the retort which serves as a disengaging zone. This zone may also contain cyclones for the removal of most of the entrained fines. The product vapors and entrained fines not collected by the cyclones leave the retort via outlet conduit 116 and are sent to the fractionator 118.

In the fractionator the contaminants are selectively enriched in the bottoms 120 which is withdrawn via conduit 122. The overhead gases consisting primarily of non-condensible gas, sour water, and naphtha are recovered by conduit 124. Kerosene/diesel fuel and gas oil are removed via conduits 126 and 128, respectively.

The heavy oil collected as bottoms is either recycled to the fractionator via conduit 130 and cooler 131 or sent to the lower section 108 of the retort via conduit 132. Preferably, the heavy oil is introduced into a part of the lower section below the principal zone of pyrolysis. As in the embodiment described in FIG. 1 the heavy oil is coked on the hot mixture of solid particles in this area depositing the majority of the collected contaminants with the coke. In an alternative embodiment, the heavy oil fraction may be mixed with the heat transfer material in conduit 106 prior to its introduction into retort 102. The cracked heavy oil vapors pass upward and are recovered with the primary product vapors. The coke and contaminants are carried with the other solids to the bottom of the retort and withdrawn by drawpipe 134. The solids from the retort are transferred to the bottom of liftpipe combustor 136 where they are entrained in a stream of air entering via 138. The carbonaceous desposits including the coke are ignited and burned to heat the particles prior to recycling as heat transfer material. The upper expanded section 140 of the combustor serves as a disengaging area. Flue gas leaves the top of the combustor via flue gas outlet 142. Hot heat transfer material is collected and recycled to the retort via recycle conduit 106.

In carrying out the invention, other types of retorting vessels and combustors may be employed. It is desirable to minimize the overlap of the pyrolysis and coking zones. The pyrolysis zone is generally a zone of high gas velocity characterized by high entrainment rates. Coke formation in this zone therefore may lead to significant re-entrainment. Most conveniently the coking step is carried out in the bottom of the retorting vessel in an area below the principal zone of pyrolysis. However, it is also possible to carry out the invention by coking the heavy oil on the pyrolyzed solids and heat transfer solids in a separate vessel from the retorting vessel.

In order to maintain the solids in the coking zone at a temperature suitable for coking the heavy oil, additional hot heat transfer solids may be added to this zone. The heavy oil may be introduced together with this supplemental heat carrier stream, thus providing initial heavy oil cracking at an elevated temperature. In general, the temperature of the coking zone should be maintained at between about 800° F. and about 1000° F., preferably between 850° F. and 950° F. At temperatures below about 800° F. the required residence time of the heavy oil in the coking zone to achieve substantial thermal cracking becomes undesirably long. At temperatures in excess of about 1000° F. the heavy oil will produce excessive amounts of non-condensible hydrocarbon gas resulting in a loss of product oil yield.

Figure 3:
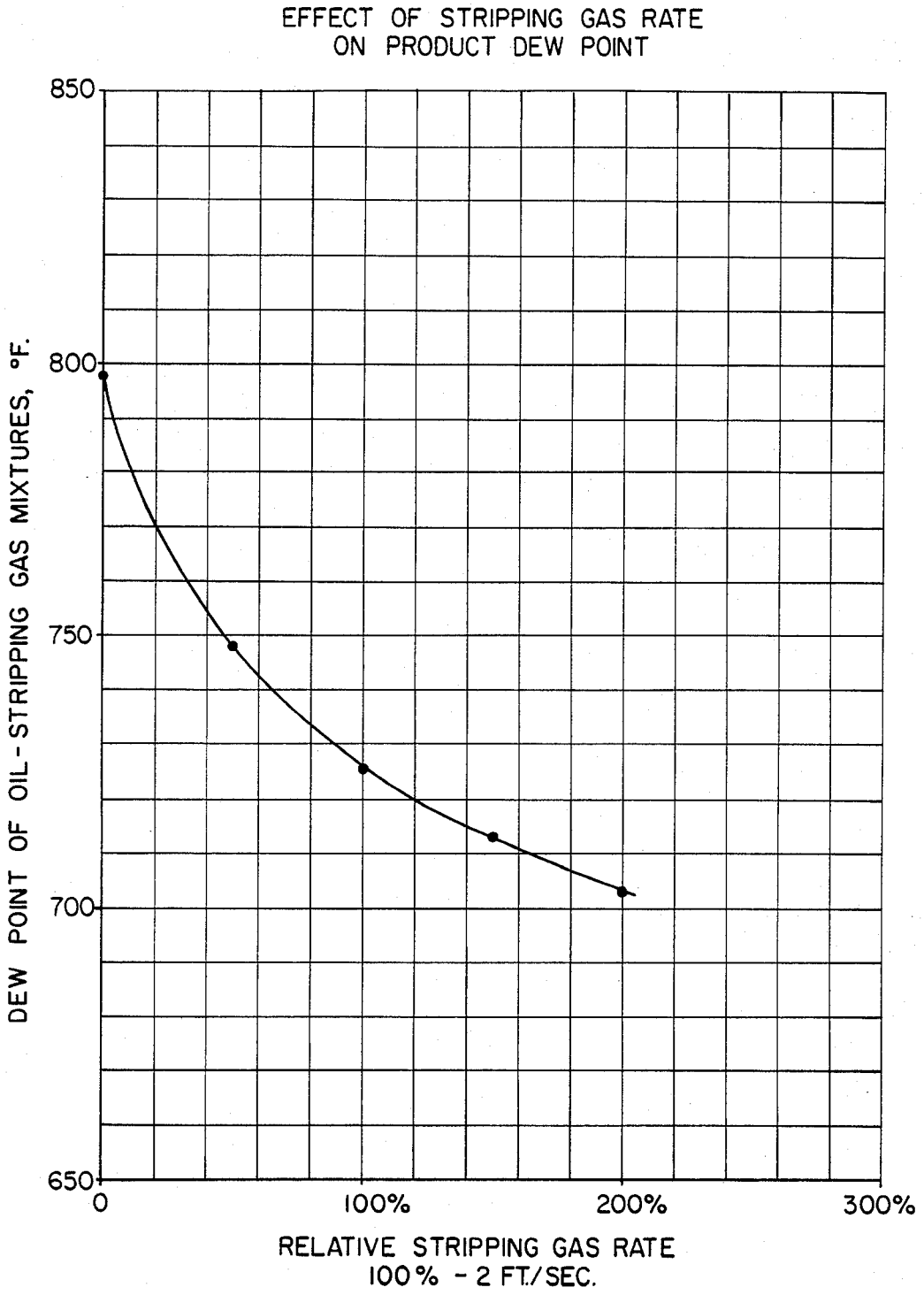
FIG. 3 is a graph illustrating the change in dew point observed in shale oil resulting from different stripping gas rates.

The importance of the presence of stripping gas in the shale oil vapor for the purpose of the invented process is demonstrated by FIG. 3. FIG. 3 shows the dew point of shale oil vapor-stripping gas mixtures as a function of injected stripping gas rate (100% corresponds to 10 moles of stripping gas per average mole of oil produced or a superficial stripping gas velocity of about 2 ft/sec. for a raw shale throughput of 4,000 lbs/hr.ft$^2$ and a shale grade of 27 Gal/Ton). An increase in stripping gas rate from 0 to 100% is shown to decrease the dew point by 70° F. This means that a heavy oil condenser with 100% stripping gas can be operated at a temperature approximately 70° F. lower than the corresponding case without stripping gas (same heavy oil fraction condensed).

Figure 4:
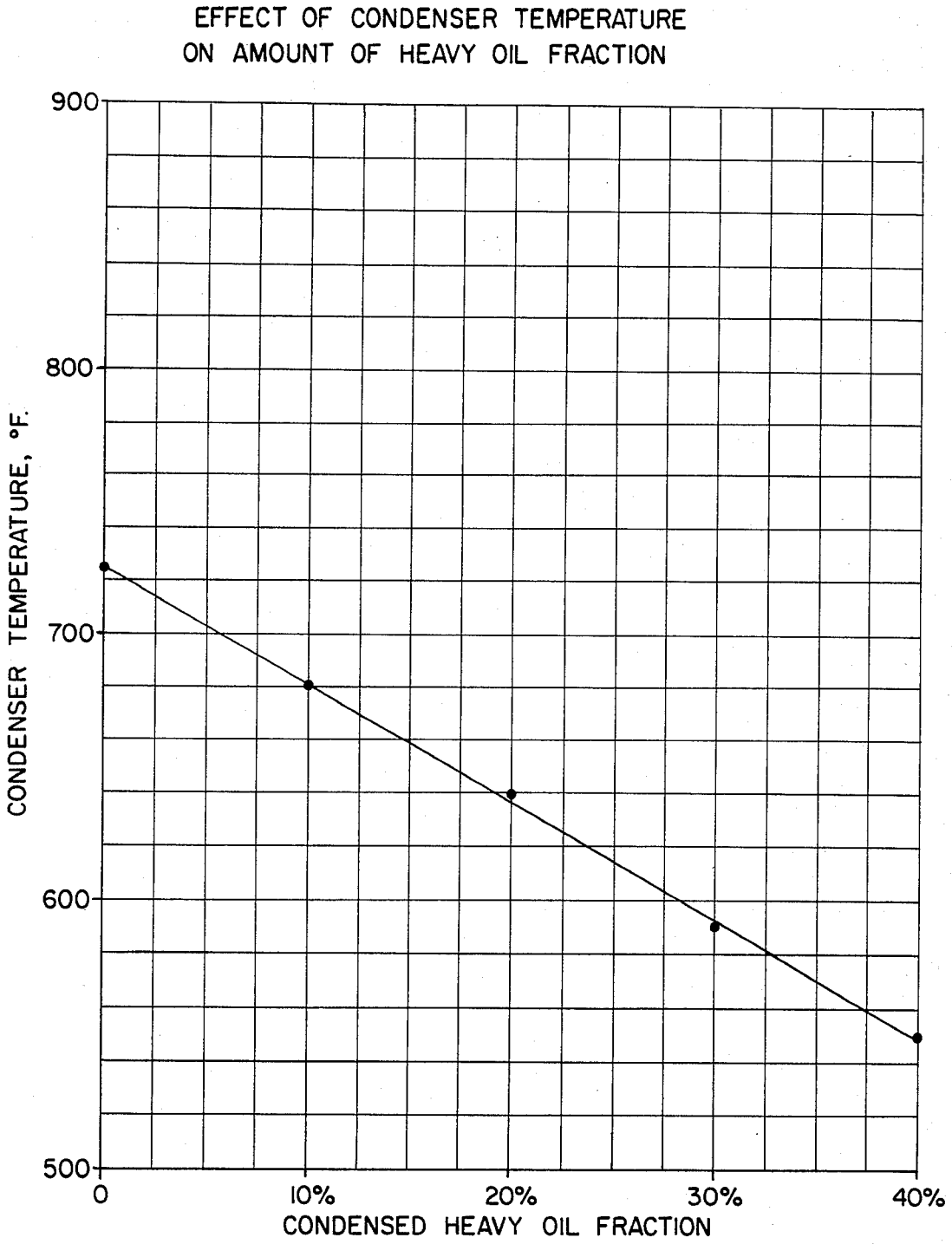
FIG. 4 shows in graphic form the effect of condensation temperature on the amount of heavy oil fraction.

FIG. 4 shows the amount of heavy oil condensed as a function of condenser temperature for the 100% stripping gas case. It is seen that a condenser temperature in the range 680°-550° F. produces a heavy oil fraction amounting to 10-10% of the primary shale oil production. Heavy oil temperatures higher than about 650° F. are undesirable because of the rapid coking reactions that occur at these elevated temperatures in the liquid-phase heavy oil. Rapid coking can result in plugging of the entire condenser system. Consequently, in the absence of stripping gas it is necessary to condense a much larger heavy oil fraction because of the dew point effect. This in turn leads to increased coke yield in the cracking step thus reducing the net oil yield.

Figure 5:
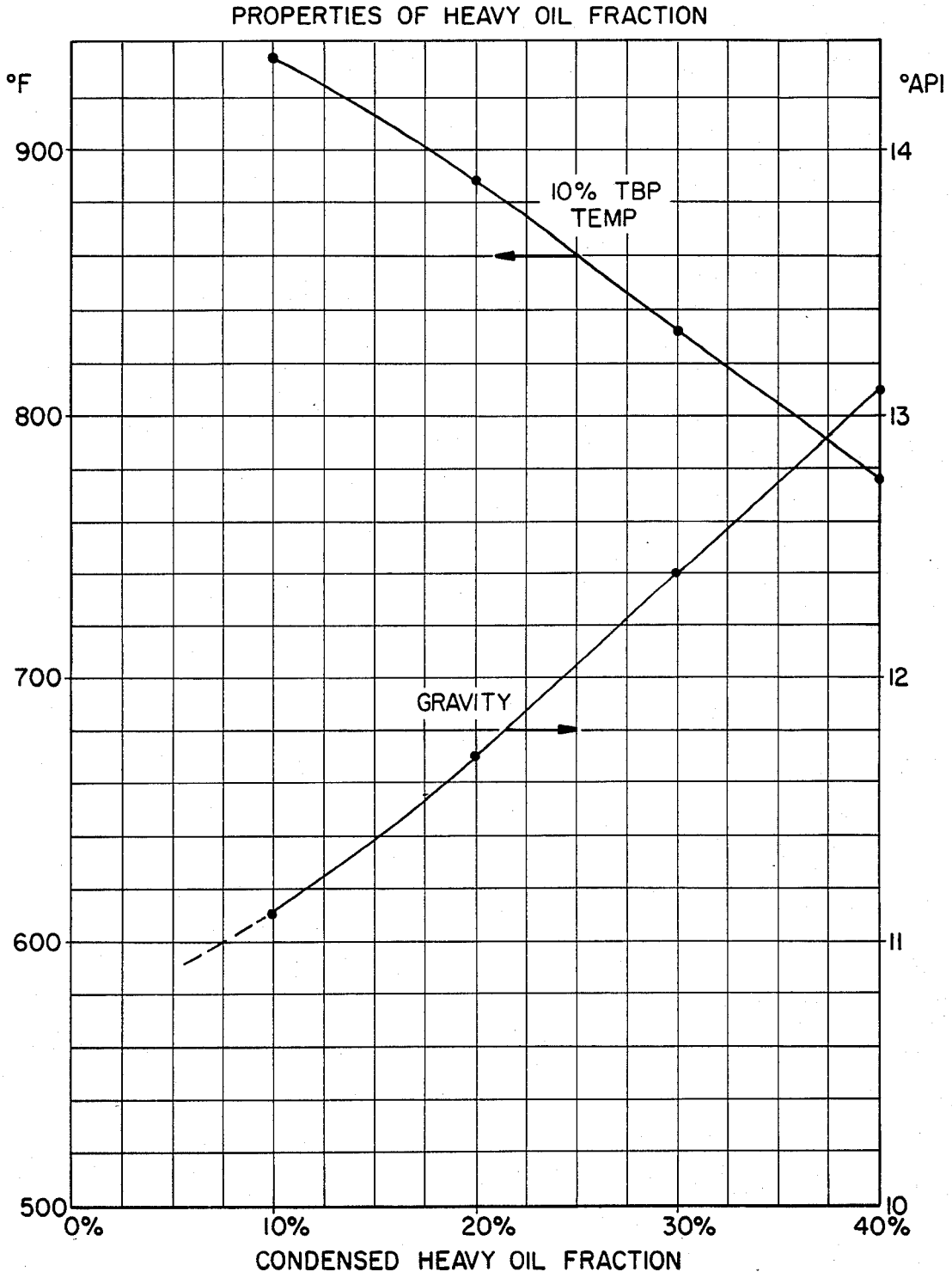
FIG. 5 shows the physical properties of the heavy shale oil fraction.

FIG. 5 shows the 10% true-boiling point temperature and the API gravity of the condensed heavy oil fraction. For comparison, the primary shale oil has a 10% TBP temperature of 300° F. and a gravity of 22° API. A 10% heavy oil fraction is seen to be mostly 935° F.+ material (90% boiling above 935° F.), a 20% heavy oil fraction is 890° F.+ and a 30% heavy oil fraction is 830° F.+. Thus, one skilled in the art will recognize that by lowering the dew point of the pyrolysis oil, it is possible to condense the contaminants in a smaller high-boiling fraction. As noted above, this objective may be accomplished by passing a stripping gas through the retort during pyrolysis of the raw feed.

In carrying out the invention, preferably at least 90% of the high-boiling fraction will have a boiling point above about 850° F. and more preferably above 950° F.

What is claimed is:

1. A process for retorting hydrocarbonaceous solid selected from the group consisting of oil shale and tar sand to recover pyrolysis oil of a lower average molecular weight and containing less contamination which comprises:

(a) mixing particulate raw hydrocarbonaceous solid with a particulate heat transfer material to raise the raw hydrocarbonaceous solid to a temperature sufficient to pyrolyze the hydrocarbonaceous fraction;

(b) pyrolyzing the hydrocarbonaceous fraction in a vertical retorting vessel by retaining the mixture of raw hydrocarbonaceous solid and hot particulate heat transfer material therein for a time sufficient to decompose a significant amount of hydrocarbonaceous fraction to form hydrocarbon vapors;

(c) passing a stripping gas through the mixture of hydrocarbonaceous solids and heat transfer material at a velocity sufficient to significantly lower the dew point of the evolved hydrocarbon vapors;

(d) recovering as pyrolysis products from the raw hydrocarbonaceous solid contaminated hydrocarbon vapors and a mixture of hot pyrolyzed solids and heat transfer material;

(e) condensing from said hydrocarbon vapors at a temperature of between 550° F. and 680° F. a high-boiling fraction containing concentrated contaminants, said high-boiling fraction being comprised of at least 90% hydrocarbons having a boiling point above 850° F.;

(f) contacting the contaminated high-boiling hydrocarbon fraction with the hot mixture of pyrolyzed solids and heat transfer material so as to thermally crack the high-boiling fraction and to deposit the contaminants along with coke on the mixture of particles; and (g) withdrawing a product oil vapor of a lower average molecular weight and having substantially reduced contamination.

2. The process of claim 1 wherein hot burned pyrolyzed solids are recycled to the retorting vessel as heat transfer material.

3. The process of claim 1 wherein the retorting vessel is designed to control gross vertical backmixing of solids.

4. The process of claim 3 wherein the high-boiling hydrocarbon fraction is recycled to the retorting vessel into a zone below the principal zone of pyrolysis.

5. The process of claim 3 wherein the high-boiling hydrocarbon fraction is introduced into a coking zone comprising a moving packed bed of solids.

6. The process of claim 3 wherein the high-boiling hydrocarbon fraction is introduced into a coking zone comprising a staged turbulent bed.

7. The process of claim 1 wherein the hot mixture of particles with which the high-boiling hydrocarbon fraction is contacted are at a temperature between about 800° F. and about 1000° F.

8. The process of claim 1 wherein the coke deposited on the particulate solids is burned to heat the heat transfer material to an elevated temperature.

9. The process of claim 1 wherein at least 90% of the high-boiling fraction boils above about 950° F.

10. The process of claim 1 wherein the high-boiling hydrocarbon fraction is mixed with hot heat carrier being introduced into the retorting vessel.

* * * * *